US009913552B2

(12) United States Patent
Elsaden et al.

(10) Patent No.: US 9,913,552 B2
(45) Date of Patent: Mar. 13, 2018

(54) TRAVEL BEVERAGE CONTAINER

(71) Applicant: Ignite USA, LLC, Chicago, IL (US)

(72) Inventors: Sami Elsaden, Winnetka, IL (US); Robert Coon, Chicago, IL (US); Joseph Chiou, Wilmette, IL (US); David Joseph, Oak Park, IL (US)

(73) Assignee: IGNITE USA, LLC, Chicago, IL (US)

( * ) Notice: Subject to any disclaimer, the term of this patent is extended or adjusted under 35 U.S.C. 154(b) by 0 days.

(21) Appl. No.: 14/602,718

(22) Filed: Jan. 22, 2015

(65) Prior Publication Data

US 2015/0201776 A1 Jul. 23, 2015

Related U.S. Application Data

(60) Provisional application No. 61/930,308, filed on Jan. 22, 2014.

(51) Int. Cl.
*A47G 19/22* (2006.01)
*B65D 47/24* (2006.01)

(52) U.S. Cl.
CPC ..... *A47G 19/2272* (2013.01); *B65D 47/248* (2013.01); *B65D 47/249* (2013.01); *B65D 2251/1008* (2013.01); *B65D 2251/1016* (2013.01)

(58) Field of Classification Search
CPC ..... A47G 19/2272; B65D 47/249; B65D 47/248; B65D 2251/1008; B65D 2251/1016; B65D 2251/08
USPC ..... 220/715, 254.1, 254.3, 518, 470, 511, 220/264
See application file for complete search history.

(56) References Cited

U.S. PATENT DOCUMENTS

| | | | |
|---|---|---|---|
| 830,142 | A | 9/1906 | Ebbing |
| 1,072,588 | A | 9/1913 | Duncan |
| 2,193,232 | A | 3/1940 | Hacmac |
| 2,447,870 | A | 8/1948 | Polcyn |

(Continued)

FOREIGN PATENT DOCUMENTS

| | | |
|---|---|---|
| JP | 2005193944 | 7/2005 |
| WO | 2005/115204 | 12/2005 |

OTHER PUBLICATIONS

International Search Report and Written Opinion for related International Patent Application No. PCT/US2015/012434, dated Apr. 17, 2015.

(Continued)

*Primary Examiner* — Jeffrey Allen
*Assistant Examiner* — Jennifer Castriotta
(74) *Attorney, Agent, or Firm* — Marshall, Gerstein & Borun LLP

(57) ABSTRACT

A cleanable lid assembly is provided for a beverage container. The lid assembly has a lid housing having a drink aperture positioned at least partially radially exterior of the connection member. The lid assembly also has a seal assembly. The seal assembly has a hinge member connected to the lid housing, a seal arm connected to the hinge member, and a drink seal connected to the seal arm. The seal assembly is connected to the lid housing while movable between a first or operable position and a second or cleaning position. The seal arm traverses both generally radially and generally axially to extend the drink seal to the drink aperture as the seal assembly transitions to the first position.

21 Claims, 8 Drawing Sheets

(56) References Cited

U.S. PATENT DOCUMENTS 2,622,420 A 12/1952 Rice
2,799,437 A 7/1957 Jepson
3,059,816 A 10/1962 Goldstein
D209,483 S 12/1967 Frank
3,635,380 A 1/1972 Fitzgerald
3,739,938 A 6/1973 Paz
3,964,631 A 6/1976 Albert
3,967,748 A 7/1976 Albert
3,972,443 A 8/1976 Albert
4,094,433 A 6/1978 Numbers
4,099,642 A 7/1978 Nergard
4,133,446 A 1/1979 Albert
4,136,799 A 1/1979 Albert
4,171,060 A 10/1979 Howard et al.
4,212,408 A 7/1980 Valenzona
4,276,992 A 7/1981 Susich
4,303,173 A 12/1981 Negard
D288,667 S 3/1987 Miner
D291,537 S 8/1987 Crawford et al.
4,686,725 A 8/1987 Mitchell
4,706,313 A 11/1987 Murphy
4,711,372 A 12/1987 Gach
4,712,704 A 12/1987 Ramsey et al.
4,779,766 A 10/1988 Kinsley
4,801,053 A 1/1989 Kaster
4,881,668 A 11/1989 Kitterman et al.
4,901,387 A 2/1990 Luke
D315,872 S 4/1991 Bixler
5,025,519 A 6/1991 Spann et al.
5,039,158 A 8/1991 Maier
5,070,560 A 12/1991 Wilkinson
5,082,134 A 1/1992 Ramsey
5,118,014 A 6/1992 Hestehave et al.
5,153,977 A 10/1992 Toida et al.
5,163,196 A 11/1992 Graebe et al.
5,169,016 A 12/1992 Hinz, Jr.
5,179,742 A 1/1993 Oberle
5,186,353 A 2/1993 Ramsey
5,199,597 A 4/1993 Gladish
5,222,623 A 6/1993 Eger et al.
5,244,113 A 9/1993 Stymiest
5,249,703 A 10/1993 Karp
5,252,278 A 10/1993 Spann et al.
5,307,950 A 5/1994 Li
D355,322 S 2/1995 Ackley et al.
5,412,821 A 5/1995 Wilkinson
5,427,271 A 6/1995 Wang
5,461,741 A 10/1995 Graebe
5,462,185 A 10/1995 Walker, III
5,465,866 A 11/1995 Belcastro
5,477,980 A 12/1995 Chaffm
5,485,938 A 1/1996 Boersma
D367,611 S 3/1996 Wagner et al.
D373,927 S 9/1996 Kramer et al.
5,570,797 A 11/1996 Yeh
5,573,139 A 11/1996 Yeh
5,580,504 A 12/1996 Spann et al.
5,586,346 A 12/1996 Stacy et al.
5,596,781 A 1/1997 Graebe
5,606,754 A 3/1997 Hand et al.
5,630,238 A 5/1997 Weismiller et al.
5,649,331 A 7/1997 Wilkinson et al.
5,652,985 A 8/1997 Wilkinson et al.
5,666,681 A 9/1997 Meyer et al.
5,680,951 A 10/1997 Feltman, III et al.
5,689,845 A 11/1997 Sobieralski
D386,948 S 12/1997 Wissinger
5,753,289 A 5/1998 Ness
D394,778 S 6/1998 Arns et al.
D397,905 S 9/1998 Hsu
5,845,352 A 12/1998 Matsler et al.
D404,613 S 1/1999 Hatsumoto et al.
D405,011 S 2/1999 DeCoster et al.
D406,006 S 2/1999 Hatsumoto et al.
D408,221 S 4/1999 Asberg
D416,755 S 11/1999 Trombly
5,987,668 A 11/1999 Ackley
D417,360 S 12/1999 Bickert et al.
6,010,029 A 1/2000 Wang
6,036,271 A 3/2000 Wilkinson et al.
6,053,474 A 4/2000 Stucke et al.
6,098,834 A * 8/2000 Hatsumoto ..... B65D 47/249 220/212.5
6,102,244 A 8/2000 Kuwano et al.
6,116,476 A * 9/2000 Huang ..... B65D 47/249 222/506
6,119,291 A 9/2000 Osborne et al.
6,126,035 A 10/2000 Schaper et al.
6,158,608 A 12/2000 Schlattl
RE37,016 E 1/2001 Morano
D437,229 S 2/2001 Andrew
6,223,369 B1 5/2001 Maier et al.
6,276,560 B1 8/2001 Belcastro
D447,693 S 9/2001 Warner et al.
6,324,709 B1 12/2001 Ikeda et al.
6,351,863 B1 3/2002 Meyer et al.
6,352,166 B1 3/2002 Copeland
6,401,990 B1 6/2002 Walters et al.
D460,894 S 7/2002 Ziegenfus et al.
6,443,325 B1 9/2002 Schaper et al.
6,471,085 B1 10/2002 Gallo
D470,009 S 2/2003 Turchi et al.
D471,808 S 3/2003 de Castro Couto
6,557,717 B1 5/2003 Keck
6,623,080 B2 9/2003 Clapper
6,644,490 B2 11/2003 Clarke
6,679,397 B2 1/2004 Smith et al.
6,701,556 B2 3/2004 Romano et al.
6,702,137 B1 3/2004 Kowa et al.
6,732,875 B2 5/2004 Smith et al.
6,732,876 B2 5/2004 Belcastro
6,732,964 B2 5/2004 Couchey
6,763,964 B1 7/2004 Hurlbut et al.
6,782,574 B2 8/2004 Totton et al.
D500,428 S 1/2005 Ward et al.
6,854,615 B2 2/2005 von Ronn et al.
D502,844 S 3/2005 Roho
6,874,185 B1 4/2005 Phillips et al.
6,877,626 B2 * 4/2005 Sherrod ..... A47G 19/2272 215/319
6,901,617 B2 6/2005 Sprouse, II et al.
D508,185 S 8/2005 Gauss
6,922,863 B2 8/2005 Giori et al.
6,928,681 B1 8/2005 Stacy
6,952,852 B2 10/2005 Reeder et al.
6,976,281 B2 12/2005 Schunk et al.
6,978,910 B2 12/2005 Sanders et al.
D513,452 S 1/2006 Parve
7,011,227 B2 3/2006 Ward et al.
D522,794 S 6/2006 Imar
D523,340 S 6/2006 Westphal
7,073,678 B1 7/2006 Dibdin et al.
D526,898 S 8/2006 Isono et al.
D526,899 S 8/2006 Mangin et al.
7,086,107 B2 8/2006 Ellis et al.
D529,379 S 10/2006 Mengeu et al.
D529,761 S 10/2006 Trombly
D533,064 S 12/2006 Glynn et al.
7,195,137 B2 3/2007 Belcastro
D540,625 S 4/2007 Sandberg
7,201,288 B2 4/2007 von Ronn et al.
D541,572 S 5/2007 Watanabe
D544,300 S 6/2007 Tien
7,229,134 B2 6/2007 Ito
D547,122 S 7/2007 Gluck
D547,611 S 7/2007 Seum et al.
D548,008 S 8/2007 Lin
D548,508 S 8/2007 Tonelli
D552,990 S 10/2007 Vogel
D554,433 S 11/2007 Gluck
D554,992 S 11/2007 Mangin et al.
D555,000 S 11/2007 Bunce et al.
D555,514 S 11/2007 Munn
D555,970 S 11/2007 Schreitmueller et al.

(56) References Cited

U.S. PATENT DOCUMENTS

| | | | | |
|---|---|---|---|---|
| D558,111 | S | 12/2007 | Banks, III | |
| D560,435 | S | 1/2008 | Meehan | |
| D564,840 | S | 3/2008 | Williams | |
| D564,841 | S | 3/2008 | Clemens et al. | |
| D564,874 | S | 3/2008 | Mangin et al. | |
| D569,182 | S | 5/2008 | Homma | |
| D572,531 | S | 7/2008 | Romandy et al. | |
| D573,404 | S | 7/2008 | Wahl | |
| 7,413,096 | B2 | 8/2008 | Morgan et al. | |
| D577,582 | S | 9/2008 | Walsh et al. | |
| D577,958 | S | 10/2008 | Homma | |
| D581,727 | S | 12/2008 | Pinelli et al. | |
| D584,107 | S | 1/2009 | George | |
| D587,060 | S | 2/2009 | Tong Chi Chung | |
| D587,969 | S | 3/2009 | Gilbert | |
| D588,411 | S | 3/2009 | Watanabe | |
| D589,750 | S | 4/2009 | Liu et al. | |
| 7,513,380 | B2 | 4/2009 | Canedo | |
| D592,012 | S | 5/2009 | Carreno | |
| D592,456 | S | 5/2009 | Pinelli | |
| D592,905 | S | 5/2009 | Pinelli | |
| D592,913 | S | 5/2009 | Pinelli | |
| 7,546,933 | B2 | 6/2009 | Pinelli | |
| D611,764 | S | 3/2010 | Wahl et al. | |
| D623,473 | S | 9/2010 | Chen | |
| D623,474 | S | 9/2010 | Carlson et al. | |
| D623,476 | S | 9/2010 | Carlson et al. | |
| D629,653 | S | 12/2010 | Gullickson et al. | |
| D634,161 | S | 3/2011 | Roth et al. | |
| RE42,484 | E | 6/2011 | Kitamura et al. | |
| D640,094 | S | 6/2011 | Carlson et al. | |
| 7,997,442 | B2 | 8/2011 | Pinelli | |
| D648,985 | S | 11/2011 | Chiu et al. | |
| D656,787 | S | 4/2012 | Phillips et al. | |
| D658,443 | S | 5/2012 | Chiu et al. | |
| D675,873 | S | 2/2013 | Miller et al. | |
| D676,278 | S | 2/2013 | Wong | |
| 8,464,895 | B2 | 6/2013 | Gilbert et al. | |
| D686,074 | S | 7/2013 | Brinckerhoff et al. | |
| 8,727,176 | B2 | 5/2014 | Ei-Saden et al. | |
| 8,844,762 | B2 | 9/2014 | Chiou et al. | |
| 8,863,979 | B2 | 10/2014 | El-Saden et al. | |
| 2003/0071041 | A1 | 4/2003 | Vogel | |
| 2005/0028289 | A1 | 2/2005 | Hakamium | |
| 2005/0029265 | A1 | 2/2005 | Morgan et al. | |
| 2006/0043091 | A1 | 3/2006 | Pinelli et al. | |
| 2006/0226160 | A1 | 10/2006 | Elsaden et al. | |
| 2007/0210093 | A1 | 9/2007 | Pinelli | |
| 2012/0018459 | A1* | 1/2012 | Richards | B65D 47/249 222/484 |
| 2012/0285961 | A1 | 11/2012 | Roth et al. | |
| 2013/0062358 | A1 | 3/2013 | El-Saden et al. | |
| 2013/0119060 | A1 | 5/2013 | Chiou et al. | |
| 2013/0175234 | A1 | 7/2013 | Mackenzie et al. | |
| 2014/0197170 | A1* | 7/2014 | Carlile | B65D 47/249 220/262 |
| 2015/0028044 | A1 | 1/2015 | Ei-Saden et al. | |

OTHER PUBLICATIONS

International Preliminary Report on Patentability, International Application No. PCT/US2015/012434, dated Aug. 4, 2016.

* cited by examiner

TRAVEL BEVERAGE CONTAINER

CROSS-REFERENCE TO RELATED APPLICATIONS

This application claims priority to U.S. Provisional Patent Application No. 61/930,308, filed Jan. 22, 2014, which is incorporated herein by reference in its entirety and made a part hereof.

FEDERALLY SPONSORED RESEARCH OR DEVELOPMENT

Not Applicable.

TECHNICAL FIELD

The present invention relates generally to a beverage container, and more specifically to a travel beverage container with a cleanable and lockable seal assembly.

BACKGROUND OF THE INVENTION

Beverage containers and seal mechanisms for beverage containers are well known in the art. Traditionally, seal mechanisms are located in the lid of the beverage container and are secured in a fixed location in the lid adjacent the various openings in the lid housing. While such beverage containers and seal mechanisms according to the prior art provide a number of advantages, they nevertheless have certain limitations. For example, debris may be retained between certain components of the seal mechanism that are secured together. Further, the area between the seals associated with the seal mechanism and the lid and other components of the seal mechanism and trigger mechanism are difficult to properly clean, especially in a dishwasher environment. The present apparatus seeks to overcome certain of these limitations and other drawbacks of the prior art and to provide new features not heretofore available. A full discussion of the features and advantages of the present apparatus is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink aperture, but where the seal assembly is not disassembled or removed from the lid during conversion from the use position to the cleaning position, and wherein the drink aperture is positioned at least partially radially exterior of a connection member connecting the lid to the beverage container.

The disclosed subject technology further relates to a cleanable lid assembly for a beverage container, comprising: a lid housing, a seal assembly, and a trigger member. The lid housing has a connection member adapted to connect the lid housing to the beverage container. The lid housing also has a drink aperture positioned at least partially radially exterior of the connection member. The seal assembly has a drink seal that closes the drink aperture. The seal assembly is connected to the lid housing while movable between a first or operable position and a second or cleaning position. The drink seal is adjacent the drink aperture and is adapted to open and close the drink aperture in the first position, and the drink seal is distal the drink aperture and the drink aperture is open for cleaning the lid assembly when the seal assembly is in the second position. A locking member is connected to the seal assembly. The locking member engages the lid housing in the first position to retain the seal assembly in the first position. The trigger member is connected to the lid housing and adapted to operate the seal assembly to open and close the drink aperture when the seal assembly is in the first position.

The disclosed subject technology further relates to a cleanable lid assembly for a beverage container, comprising a lid housing and a seal assembly, where the lid housing has a connection member adapted to connect the lid housing to the beverage container, where the lid housing also has a drink aperture positioned at least partially radially exterior of the connection member, and where the seal assembly has a hinge member connected to the lid housing. The seal assembly also has a seal arm connected to the hinge member, and a drink seal connected to the seal arm. The seal assembly is connected to the lid housing while movable between a first or operable position and a second or cleaning position. The seal arm traverses both generally radially and generally axially to extend the drink seal to the drink aperture as the seal assembly transitions to the first position. The drink seal is adjacent the drink aperture and adapted to open and close the drink aperture in the first position, and the drink seal is distal the drink aperture and the drink aperture is open for cleaning the lid assembly when the seal assembly is in the second position.

The disclosed subject technology further relates to a cleanable lid assembly for a beverage container, comprising a lid housing having a drink aperture, and a seal assembly having a hinge member connected to the lid housing. The seal assembly also has a seal arm connected to the hinge member, and a drink seal connected to the seal arm. The seal assembly is connected to the lid housing while movable between a first or operable position and a second or cleaning position. The lid housing has a cam surface, and the seal arm has a cam follower that engages the cam surface to assist the seal arm in traversing both generally radially and generally axially to extend the drink seal to the drink aperture as the seal assembly transitions to the first position. The drink seal is adjacent the drink aperture and adapted to open and close the drink aperture in the first position, and the drink seal is distal the drink aperture and the drink aperture is open for cleaning the lid assembly when the seal assembly is in the second position.

The disclosed subject technology further relates to a locking member that is moveable radially inward to disengage the seal assembly from the first position and to allow the seal assembly to be transitioned to the cleaning position.

The disclosed subject technology further relates to a seal assembly that cannot be operated by the trigger member to open and close the drink aperture when the seal assembly is in the second position.

The disclosed subject technology further relates to a seal assembly that further comprises a hinge member connected to the lid housing and a seal arm connected to the hinge member, and where the drink seal is connected to the seal arm.

The disclosed subject technology further relates to a seal arm that traverses both generally radially and generally axially to extend the drink seal to the drink aperture.

The disclosed subject technology further relates to a lid housing that has a cam surface and wherein the seal arm has a cam follower that engages the cam surface to assist the seal arm in traversing both generally radially and generally axially to extend the drink seal to the drink aperture.

The disclosed subject technology further relates to a hinge member that has a first portion that is generally perpendicular to a longitudinal axis of the container body when the seal assembly is in the first position, and a second portion that is generally parallel to the longitudinal axis of the container body when the seal assembly is in the first position. A locking member on the hinge member extends from the second portion that is generally parallel to the longitudinal axis of the container body. A joint is provided between the first portion of the hinge member and the second portion of the hinge member, the second portion of the hinge member being adapted to be flexed radially inward to release the locking member from the lid assembly to transition the seal assembly to the cleaning position.

The disclosed subject technology further relates to a portion of a hinge member that extends radially exterior of the connection member of the lid housing when the seal assembly is in the cleaning position to assist in preventing the lid assembly from being connected to the container member when the seal assembly is in the cleaning position.

The disclosed subject technology further relates to a spring to bias the seal assembly toward the cleaning position when the locking member is disengaged from the lid assembly.

The disclosed subject technology further relates to a trigger member that is operated by pushing the trigger member in a direction substantially perpendicular to a longitudinal axis of the beverage container.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

DETAILED DESCRIPTION

Figure 1:
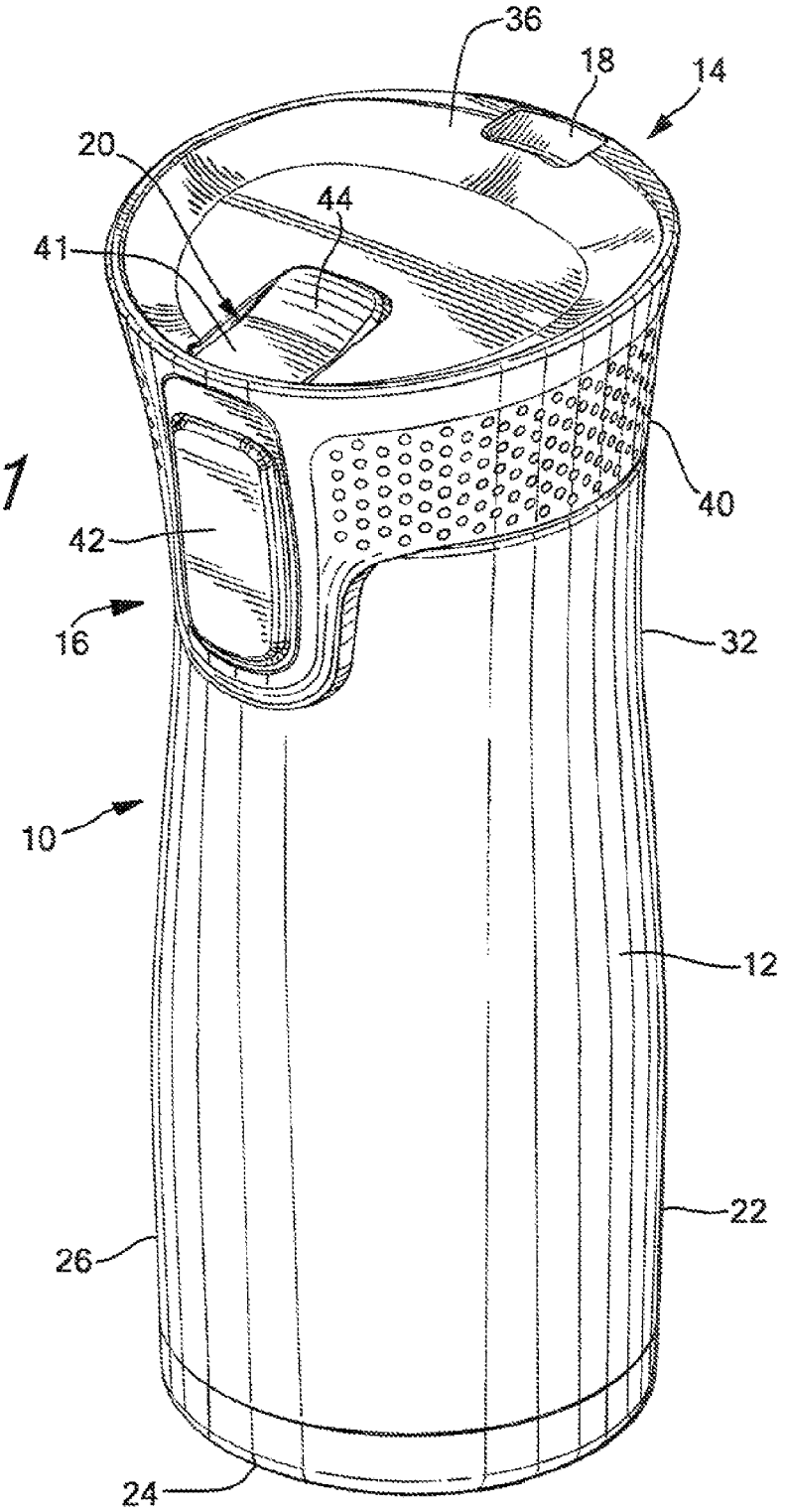
FIG. 1 is a perspective view of one example of a beverage container with a moveable and lockable seal assembly.
Figure 2:
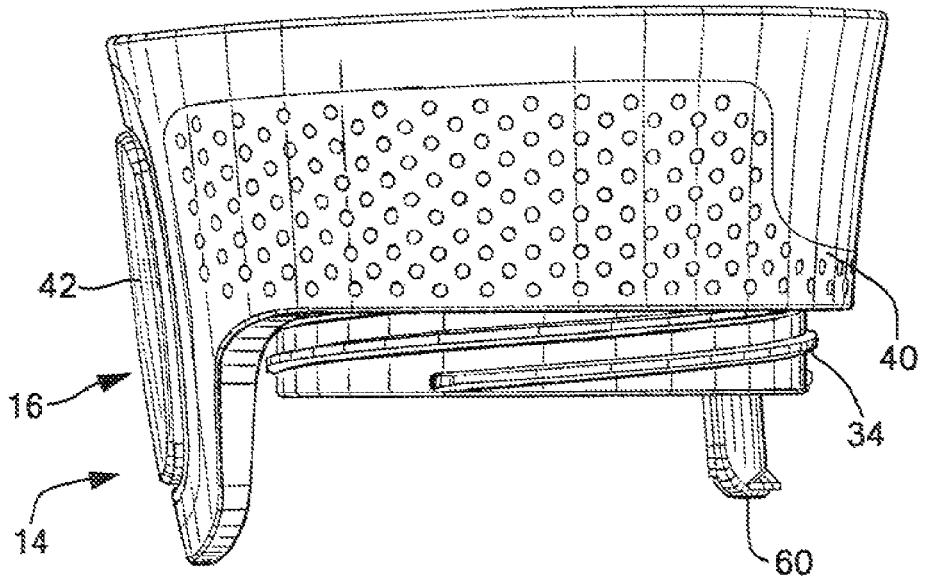
FIG. 2 is a side elevation view of one embodiment of the lid of the beverage container of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, and specifically to FIGS. 1-8, there is shown a beverage container 10 generally comprising a container body 12 and a cleanable lid assembly 14. The lid assembly 14 has a trigger mechanism 16 that operates to open and close a drinking aperture 18 in the lid assembly 14. Additionally, the trigger mechanism 16 also preferably operates to open and close a vent aperture 20 to allow pressure residing within the container body 12 to be initially released through the vent aperture 20 as opposed to the drink aperture 18. In a preferred embodiment, as shown in FIGS. 5-10, a portion of the trigger mechanism 16, referred to herein as the seal mechanism, can be released from a first position, also referred to as the operable position, the fixed position and the closed position, to a second position, also referred to as the cleaning position, released position and open position, to allow for cleaning of various components of the trigger mechanism 16 and for cleaning of areas between components of the trigger mechanism 16 and the lid assembly 14.

In one embodiment the container body 12 comprises a side wall member 22, a bottom member 24 toward a distal end 26 of the side wall member 22, and a liquid retaining cavity (not shown) therebetween. Further, in another embodiment the container body 12 preferably comprises a two-part construction of an inner member and an outer member to provide an insulating feature. The area between the inner member and the outer member may be filled with an insulating material or it may be under vacuum.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating thread-ring receiver on the container body 12, however, alternate connection means may be utilized. In one embodiment the thread ring 34 extends from or is fixedly connected to the lid housing 40 as shown in FIGS. 2-5. As shown in FIG. 5, the lid assembly 14 further includes a seal 202 that seals the connection between the container body 12 and the lid assembly 14 when the container body 12 is connected to the lid assembly 14 to assist in preventing liquid from escaping from the cavity of the container body 12 between the container body 12 and the lid assembly 14.

In one embodiment the lid assembly 14 comprises a lid housing 40 for retaining the trigger mechanism 16. The lid housing 40 has a connection member adapted to connect the lid housing 40 to the beverage container 12. As explained above, in one embodiment the connection member is a thread ring 34. The drink aperture 18 is provided in the top surface 36 of the lid housing 40, and in one embodiment a ramp 38 extends from the drink aperture 18 at an angle to the top surface 36 of the lid and toward a perimeter of the lid housing 40. The ramp 38 helps to direct fluid being dispensed from the container through the drink aperture 18 toward the user's mouth. The ramp 38 also helps to direct any liquid that is not drunk by the user back through the drink aperture 18 and into the container cavity. In a preferred embodiment the drink aperture 18 is not provided radially interior of the thread ring 34 of the lid assembly 14, as with numerous prior art devices. Instead, in a preferred embodiment the drink aperture 18 is positioned at least partially radially exterior of the connection member, i.e., at least partially exterior of the thread ring 34 as shown in the figures. Further, in a more preferred embodiment the drink aperture 18 is provided generally concentric with the thread ring 34, and therefore substantially concentric with the container body 12. Accordingly, in such an embodiment the drink aperture 18 is provided much more toward the perimeter of the top surface 36 of the lid housing 40 for easy drinking by the user.

The lid assembly 14 also has a trigger member or trigger button 42 that operates to actuate the trigger mechanism 16. The trigger member 42 is preferably operated by pushing the trigger member 42 in a direction substantially perpendicular to a longitudinal axis of the beverage container 10. The lid assembly 14 also has a trigger lock mechanism 44 for locking the trigger member 42 and preventing the user from actuating the trigger mechanism 16 when the trigger member 42 is locked to prevent unwanted opening of the drink aperture 18. As shown in FIGS. 1 and 5, the trigger lock mechanism 44 is in the locked position so that the trigger button 42 cannot be operated, and in FIGS. 6, 8 and 9 the trigger lock mechanism 44 is in the unlocked position so that the trigger button 42 can be operated to open the drink aperture 18.

The lid housing 40 of the lid assembly 14 has a plurality of apertures therein. Preferably, the lid housing 40 contains the drink aperture 18 (see FIGS. 1, 5, 6 and 7-9) and the vent aperture 20 (see FIGS. 5, 6 and 7-9) that provide egress for the contents in the container cavity through the lid housing 40. Generally, the operation of the trigger assembly 16, and particularly the operation of the vent seal 64 of the vent aperture 20, provides to allow pressure residing within the container body 12 to preferably be initially released through the vent aperture 20 as opposed to the drink aperture 18. In one embodiment, the vent aperture 20 is provided in a position in the lid housing 40 that is underneath the vent deflector 41 that is a part of the trigger lock mechanism 44.

Figure 7:
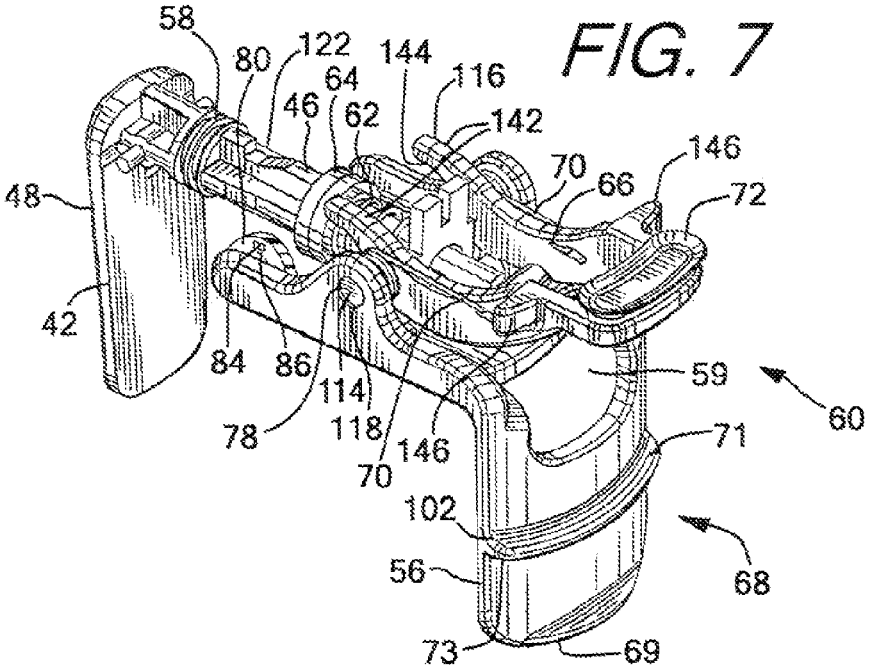
FIG. 7 is a perspective view of one embodiment of a moveable seal assembly and trigger assembly for a beverage container.
Figure 5:
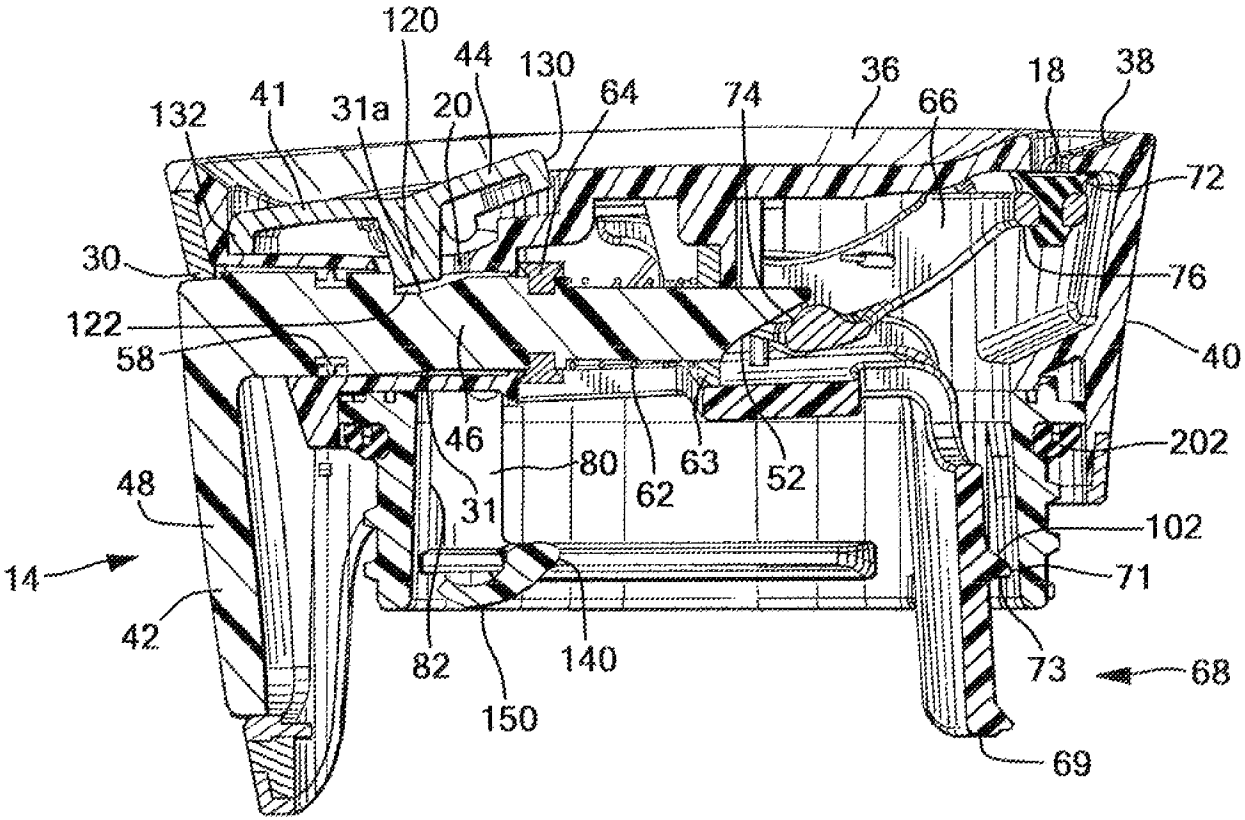
FIG. 5 is a cross-sectional side view of one embodiment of a lid for a beverage container, including a moveable seal assembly in the engaged position and a trigger assembly in the locked position.
Figure 6:
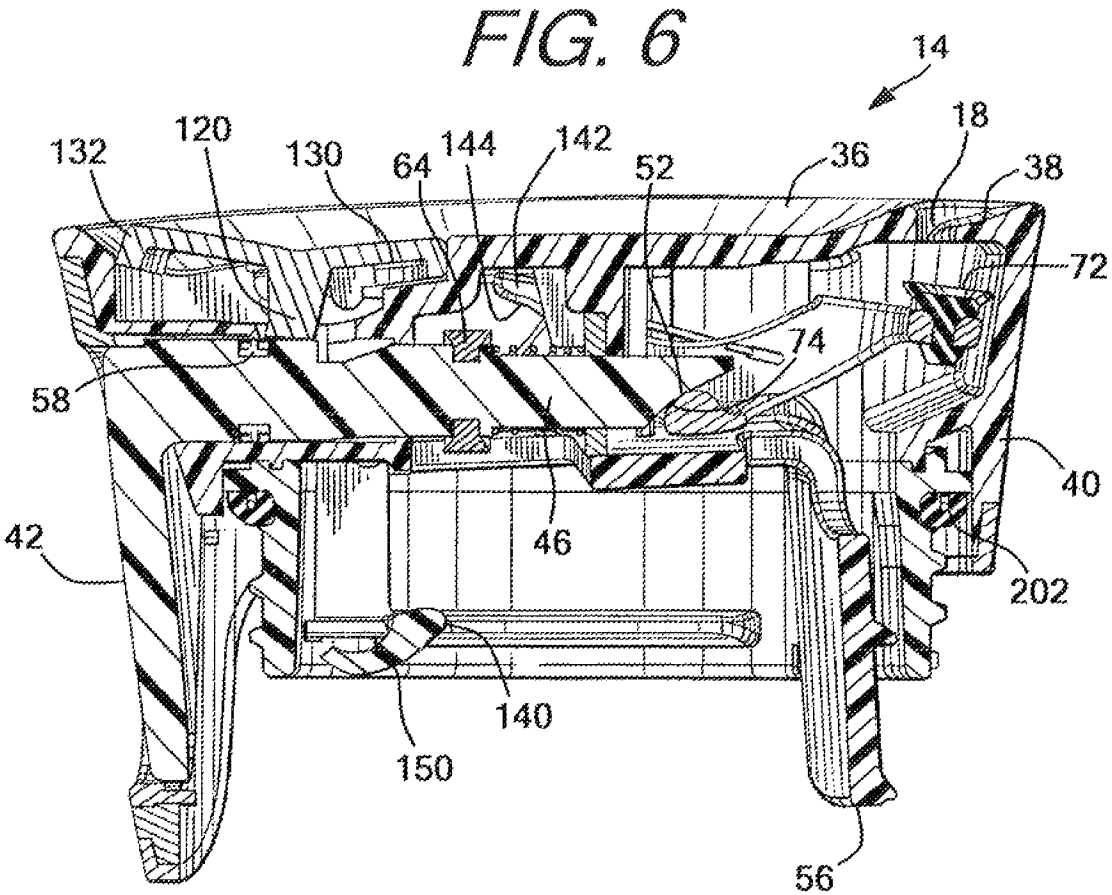
FIG. 6 is a cross-sectional side view of the lid of FIG. 5 with the moveable seal assembly in the unlocked position and the trigger actuated.
Figure 8:
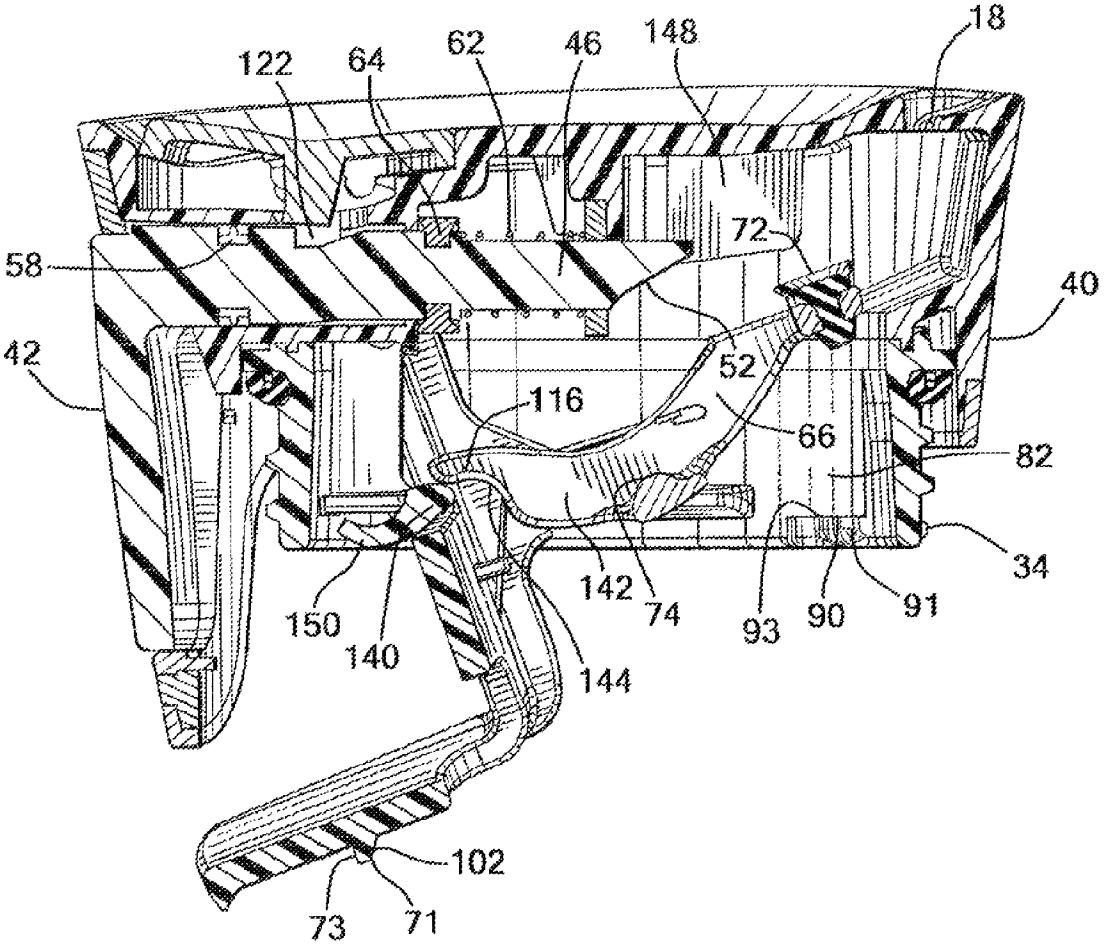
FIG. 8 is a cross-sectional view of the lid of FIG. 5 with the movable seal assembly being transitioned to the cleaning position.
Figure 9:
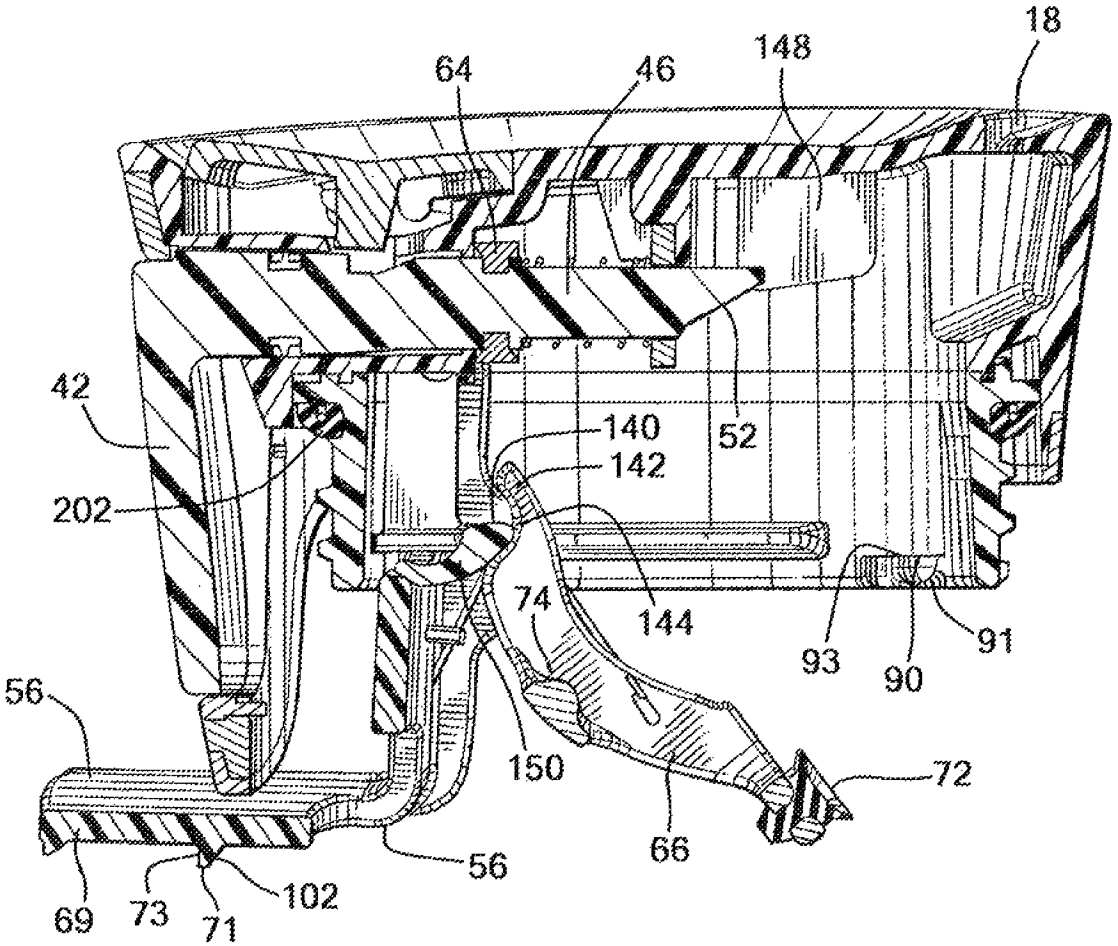
FIG. 9 is a cross-section side view of the lid of FIG. 5 with the moveable seal assembly in the open/cleaning position.

As best shown in FIGS. 5-9, in various embodiments the trigger assembly 16 generally comprises a trigger member 42, a hinge member 56, a drop-down spring (not shown), a trigger seal 58, a trigger spring 62, a washer 63, a vent seal 64, a seal arm 66, a drink spring 70 and a drink seal 72. In an alternate embodiment no drop-down spring is provided. Further, a portion of the overall trigger assembly 16 may be referred to as the seal assembly 60. In one embodiment the components of the seal assembly 60 generally comprise the hinge member 56, the seal arm 66, the drink spring 70, the drink seal 72, and optionally a drop down spring (not shown). The drink seal 72 closes the drink aperture 18. In one embodiment, the seal assembly 60 is connected to the lid housing 40 while movable between a first or operable position (i.e., as shown in FIGS. 5 and 6), and a second or cleaning position (i.e., as shown in FIGS. 8 and 9). The drink seal 72 is adjacent the drink aperture 18 and is adapted to open and close the drink aperture 18 in the first position. The drink seal 72 is distal the drink aperture 18 and the drink aperture 18 is open for cleaning the lid assembly 14 when the seal assembly 60 is in the second position.

Referring to FIGS. 5-10, in one embodiment the trigger member 42 of the trigger assembly 16 is generally L-shaped, with a main body portion 46 and a transverse portion 48 extending downwardly therefrom. Moreover, in a preferred embodiment the main body portion 46 has a shaft-like shape. The main body portion 46, however, has various cutouts about an exterior of its body (see FIG. 7) to allow gaseous fluid to pass by the exterior of the trigger member and out the vent aperture 20. In a preferred embodiment, the main body portion 46 of the trigger member 42 has an X-shaped cross-section to allow gaseous fluid to pass therethrough. The trigger member 42 has a distal end 52 that engages the seal arm 66 to rotate the seal arm 66 about its pivot point, as discussed more fully herein, thereby disengaging the drink seal 72 from the drink aperture 18 in the lid assembly 14 to operably open and close the drink aperture 18. The trigger member 42 is connected to the lid housing 40 and adapted to operate the seal assembly 60 to open and close the drink aperture 18 when the seal assembly 60 is in the first position.

The main body portion 46 of the trigger 42 extends through an access aperture 30 in the lid housing 40, and into a trigger chamber 31 in the lid assembly 14. A portion of the main body portion 46 of the trigger 42 is generally housed within the trigger chamber 31, and a portion of the main body portion 46 of the trigger 42, including the distal end of the trigger 52, extends out of the trigger chamber 31, which can also be referred to as the vent chamber, and into the cavity of the lid assembly 14 to contact the seal arm 66.

In a preferred embodiment the trigger 42 seats several seals, including the trigger seal 58 and the vent seal 64. As shown in FIGS. 5-9, the trigger seal 58 and the vent seal 64 are both seated on the main body portion 46 of the trigger 42. Since the trigger 42 extends through the access aperture 30 and through the vent chamber, the trigger seal 58 is required to seal the access aperture opening 30 once the trigger 42 is inserted into the lid assembly 14. In a preferred embodiment the interior of the trigger chamber 31, a portion of which comprises the vent chamber, has a cylindrical shape and thus in this embodiment the trigger seal 58 is a wiper O-ring that is seated in an arcuate recess on the main body portion 46 of the trigger 42. The trigger seal 58 thus operates as a wiper seal contacting the interior surface of the trigger chamber 31 to seal the area between the interior surface of the trigger chamber 31 and the trigger 42 to prevent any liquid or vapor from escaping out of the trigger chamber 31 through the access aperture 30. The trigger seal 58 is positioned on the trigger 42 between the vent aperture 20 and the access aperture 30. In this manner the trigger seal 58 also operates as an end wall for the vent chamber portion 31*a* of the trigger chamber 31.

The vent seal 64 is also seated on the main body portion 46 of the trigger 42, however, the vent seal 64 is seated more toward the distal end 52 of the trigger 42 than the trigger seal 58. Like the trigger seal 58, the vent seal 64 is seated in an arcuate recess on the main body portion 46 of the trigger 42. This recess, however, is positioned outside of the trigger chamber 31 and adjacent the entrance aperture to the trigger chamber 31 and vent chamber 31*a*. Accordingly, in this manner the vent seal 64 operates to seal the entrance to the vent chamber 31*a* and trigger chamber 31 in a first normal position, as shown in FIG. 5, and to open the entrance to the vent chamber 31*a* and trigger chamber 31 immediately upon actuation of the trigger mechanism 16, including in the fully actuated position of FIG. 6.

Referring to FIGS. 3-9, the trigger spring 62 is positioned around the main body portion 46 of the trigger 42 between the vent seal 64 and the washer 63, and adjacent the distal end 52 of the trigger member 42. In a preferred embodiment the trigger spring 62 is a compression spring. One end of the trigger spring 62 is fixed in place against the washer 63. The washer 63 is fixed axially against a wall of the lid housing 40 by the spring force of the trigger spring 62. The washer 63 is not fixed to the trigger 42, but may be fitted within a slot in the wall of the lid housing 40, to allow the main body portion 46 of the trigger member 42 to pass freely through the washer 63 for actuation of the seal arm 66. Thus, the other end of the trigger spring 62 exerts an outwardly force on the vent seal 64, or to a shoulder of the trigger 42 in an attempt to maintain the trigger 42 in the normal or unactuated position (see FIG. 5). In this position the vent seal 64 is pushed up against the outside of the trigger chamber 31 at the entrance thereto, effectively sealing the entrance to the vent chamber 31*a* and the trigger chamber 31 to preclude any liquid or vapor from being able to escape out of the container cavity 28 prior to actuation of the trigger assembly 16.

The transverse portion 48 of the trigger member 42 is fixedly connected to and preferably integral with the main body portion 46 of the trigger member 42. Thus, the transverse portion 48 operates as a push-button actuator to actuate the trigger mechanism 16 and sealing assembly 60. The trigger mechanism 16 can be actuated by exerting a generally radially inward force on the trigger member 42 to overcome the opposite force of the trigger spring 62 to push the trigger member 42 radially inward in the lid assembly 14 or toward a center of the lid assembly 14, and preferably in a direction transverse to an axis extending about a length of the beverage container 10. The trigger member 42 is thus moveable from a first normal or non-actuated position shown in FIG. 5, to a partially actuated position (not shown), and ultimately to a fully actuated position shown in FIG. 6. In the partially actuated position the vent seal 64 is in the open position allowing vapor and internal pressure to be released from the container cavity 28 through the trigger chamber 31 and vent chamber and to exit out the vent orifice 20, but the drink seal 72 is closed sealing the drinking orifice 18. The gap between the distal end 52 of the trigger member 42 and the seal arm 66, shown in FIG. 5, provides a delay whereby the vent seal 64 will be moved from the opening to the trigger chamber 31 and vent chamber 31*a* allowing vapor and internal pressure to be released out the vent opening 20, but the distal end 52 of the trigger member 42 will not have contacted or engaged the seal arm 66 so the drink seal 72 remains closed on the drink opening 18. Conversely, in the fully actuated position (FIG. 6) the distal end 52 of the trigger member 42 has engaged the seal arm 66, thereby rotating the seal arm 66 about its pivot point 78, such that both the vent seal 64 and drink seal 72 are in the open position allowing liquid to be expelled out the drinking orifice 18 and allowing vapor and pressure to continue to be released from the vent opening 20.

As explained above and shown in the Figures, the trigger 42 is mechanically connected to the drink seal 72 through the seal arm 66 when the trigger 42 is actuated a sufficient distance such that the distal end 52 of the trigger 42 contacts the seal arm 66.

Referring to FIGS. 7-10, in one embodiment a portion of the trigger assembly 16, preferably the seal assembly 60, is hingedly or rotatedly connected to the interior portion of the lid housing 40 of the lid assembly 14. In one embodiment, the seal assembly 60 comprises a hinge member 56 connected to the lid housing 40 and a seal arm 66 connected to the hinge member 56. Additionally, in such an embodiment, the drink seal 72 is connected to the seal arm 66. In one embodiment, a pair of arms 80 extend transversely from the interior wall 82 of the lid housing 40 (see FIGS. 5 and 7) to secure the seal assembly 60 to the lid housing 40. The arms 80 have a receiver 84 for rotatedly securing the hinge member 56 to the lid housing 40. In one embodiment, the receiver 84 in the arms 80 is a bore 84 that is sized to allow extensions 86 of the hinge member 56 to extend and rotate therewithin. Referring to FIG. 7, in one embodiment the extensions 86 comprise shaft-like members that extend from the body of the hinge member 56 and into the receivers 84 in the arms 80 of the lid housing 40. As such, the hinge member 56, and the seal assembly 60 therewith, when unlocked, can rotate down from its engaged position about the extensions 86 that rotate within the receivers 84 to allow access to various components of the seal assembly 60, trigger assembly 16 and lid assembly 14 for cleaning purposes. The seal assembly 60 cannot be operated by the trigger member 42 to open and close the drink aperture 18 when the seal assembly 60 is in the second position.

Figure 10:
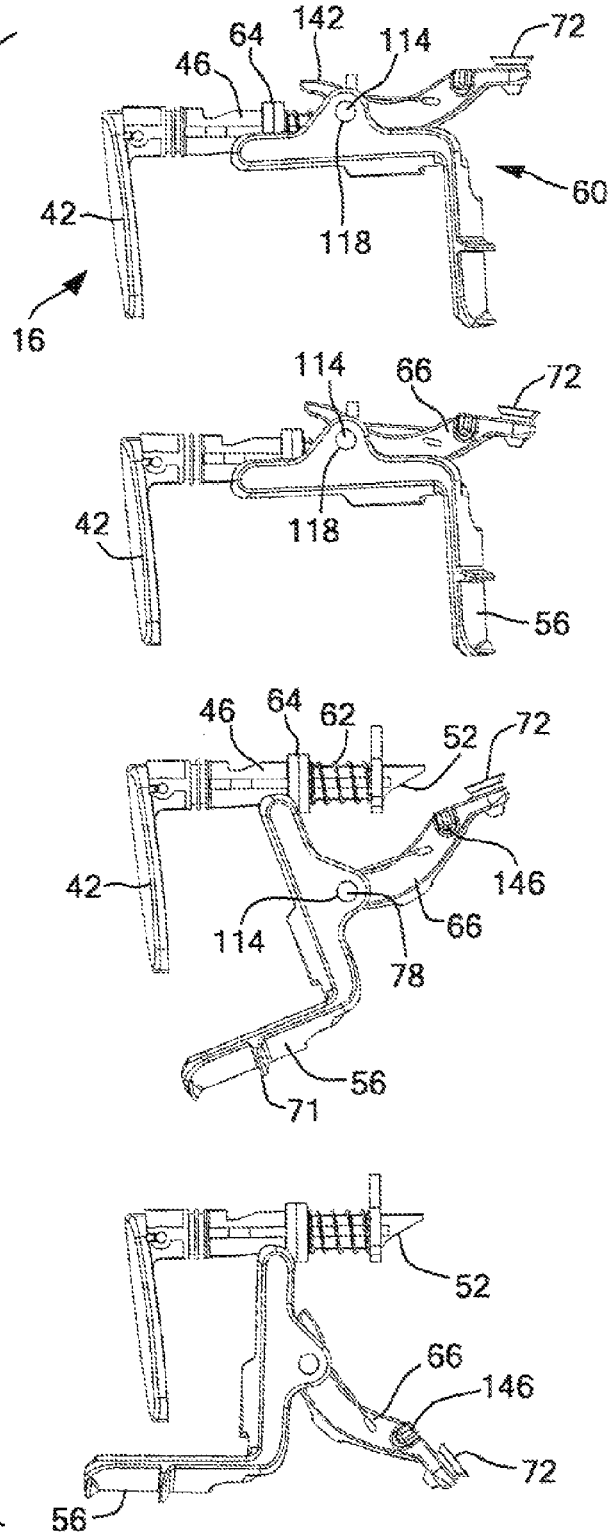
FIG. 10 is a schematic showing the movement of the moveable seal assembly.

The seal assembly 60, however, can be locked and unlocked to the lid housing 40 to either maintain the seal assembly 60 in the operable position (as shown in FIGS. 2-7), or to allow the seal assembly 60 to be rotated downward for cleaning (as shown in FIGS. 8-10). The rotatable portion of the seal assembly 60 comprises one or more of the following components: the hinge member 56, the drop down spring (if provided), the seal arm 66, the drink spring 70 and the drink seal 72. In one embodiment, the hinge member 56 has a seal arm locking member 68. In a preferred embodiment the seal arm locking member 68 comprises a locking extension 69 of or from the hinge member 56 that can be grasped by the user to unlock the hinge member 56 from the lid housing 40 so that the seal assembly 60 can be rotated outwardly to the open position for cleaning. In one embodiment the hinge member 56 has a first portion that is generally perpendicular to a longitudinal axis of the container body 12 when the seal assembly 60 is in the first position, and a second portion 69, such as a locking extension 69, that is generally parallel to the longitudinal axis of the container body 12 when the seal assembly 60 is in the first position. Additionally, as explained below, a locking member 68 extends from the second portion that is generally parallel to the longitudinal axis of the container body 12. A joint is provided between the first portion of the hinge member 56 and the second portion of the hinge member 56 so that the second portion of the hinge member 56 can be flexed radially inward to release the locking member 68 from the lid assembly 40 to transition the seal assembly 60 to the cleaning position.

In a further preferred embodiment the locking extension 69 of the seal arm locking member 68 has a locking flange 71 to lock the seal arm locking member 68 to the lid housing 40. In a preferred embodiment, the locking flange 71 and the locking extension 69 are a unitary component with the hinge member 56. The locking member 68 is connected to the seal assembly 14, and the locking member 68 engages the lid housing 40 in the first position to retain the seal assembly 60 in the first position.

In a preferred embodiment, the hinge member 56 and the seal arm locking member 68 are components of the seal assembly 60 and the trigger assembly 16. The seal arm locking member 68 is used to lock the seal assembly 60and trigger assembly 16 in the operable position, and further unlock the seal assembly 60 and trigger assembly 16 for transitioning to the unlocked or cleaning position. In one embodiment, locking extension 69 of the seal arm locking member 68 is resilient and able to be flexed at the joint where it connects to the hinge member 56 when pressure is applied by the user as explained herein to assist in the unlocking process. In one embodiment, the locking member 68 is moveable radially inward to disengage the seal assembly 60 from the first position and to allow the seal assembly 60 to be transitioned to the cleaning position. In a preferred embodiment the second portion of the hinge member 56 extends radially exterior of the connection member 34 of the lid housing 40 when the seal assembly 60 is in the cleaning position to assist in preventing the lid assembly 14 from being connected to the container body 12 when the seal assembly 60 is in the cleaning position.

As best shown in FIGS. 5-6 and 9, the locking flange 71 of the seal arm locking member 68 extends transversely from the locking extension 69. In one embodiment the seal arm locking member 68 has one locking flange 71 extending away from the locking extension 69, however, additional locking flanges 71 may be included. In a preferred embodiment, each of the locking flanges 71 have a top surface 102 that operates as a cam follower 102 to engage a cam surface 91 of respective retaining members 90 on the inner wall 82 of the thread ring 34 of the lid housing 40 (See FIGS. 5-9). In a preferred embodiment, the cam surface 102 of the locking flange 71 has an arcuate geometry. The locking flange 71 also has a flat 73. In one embodiment the flat 73 operates as a stop and is opposite the cam follower surface 102. The flat 73 does not have to have a flat geometry.

In one embodiment the lid housing 40 has a receiving member 90, see FIGS. 8-9 and 10, that provides a cam receiving surface 91 and a stop surface 93 for receiving the locking flange 71, and thus for retaining the seal assembly 60 in the locked position. In a preferred embodiment, two receiving members 90 are provided and they extend transversely from the interior wall 82 of the lid housing 40. In one embodiment, the cam receiving surface 91 is arcuate in shape.

The cam follower surface 102 of the locking flange 71 engages the cam receiving surface 91 of the receiving members 90 when the seal arm locking member 68 is pushed inwardly or upwardly toward an interior of the lid housing 40 from the cleaning position. The locking extension 69 can flex radially inwardly as the cam follower surface 102 traverses on the cam receiving surface 91. When the seal arm locking member 68 is pushed a certain distance, the flat 73 of the locking flange 71 moves beyond the cam receiving surface 91 of the receiving member 90 and the locking extension 69 will flex or snap outwardly so that the flat 73 on the seal arm locking member 68 rests on the step 93 of the receiving member 90 to lock the seal assembly 60 to the lid assembly 14 in the closed or locked position in the lid assembly 14 (see FIGS. 3-6). Accordingly, the cam receiving surfaces 91 of the receiving members 90 operate as cam surfaces for the cam follower surface 102 of the locking flange 71. When the seal arm locking member 68 has been pushed far enough and the seal arm locking member 68 having the locking flange 71 springs outwardly so that the flat 73 of the locking flange 71 engages the stops 93 of the receiving members 90 in a snap-fit manner, the user is provided with a tactile sensation indicating that the proper insertion of the seal arm locking member 68 has been achieved, and the seal arm locking member 68 and hinge member 56 have been properly locked in the use position. The engagement of the locking flange 71 with the receiving member 90 also operates to fix the seal assembly 60 in the locked position until unlocked by the user for cleaning. In this manner the seal assembly 60 will not become unintentionally unlocked.

To unlock the seal arm locking member 68, and thus the seal assembly 60, the user pushes the locking extension 69 of the seal arm locking member 68 inwardly toward the center of the lid housing 40. The seal arm locking member 68 will flex at the joint with the hinge member 56 allowing the seal arm locking member 68 to flex inwardly. When the flat 73 of the locking flange 71 clears the stop 93 of the receiving member 90, the user can also pull the seal arm locking member 68 outwardly from the lid housing 40. Additionally, the drop down spring (if provided), which in one embodiment is preferably a torsion spring, exerts a force on the seal assembly 60 to rotate the seal assembly into the cleaning position as shown in FIGS. 8-10. In one embodiment, the drop down spring operates to maintain the seal assembly 60 in the open or cleaning position until a user exerts a force sufficient to overcome the spring force of the drop down spring and to place the seal assembly 60 in the use position. Thus, during cleaning, for example in a dishwasher, the seal assembly 60 will be maintained open by the drop down spring. However, if no drop down spring is provided, the drink spring 70 may assist, in various embodiments, in performing certain functions of the drop down spring explained above, including, but not limited to, exerting a force on the seal assembly 60 to rotate the seal assembly into the cleaning position. Thus, in one embodiment, the drink spring 70 may bias the seal assembly 60 toward the cleaning position when the locking member 68 is disengaged from the lid assembly. Additionally, as explained herein, a retaining stop 140 is provided to retain the seal assembly 60 in the cleaning position until released by the user.

Referring now to FIGS. 7-10, in one embodiment the seal arm 66 of the seal assembly 60 is pivotally attached to the hinge member 56. The seal arm 66 has an engaging member 74 that is engaged by the distal end 52 of the trigger 42 during actuation of the trigger mechanism 16. As shown in FIG. 5, the engaging member 74 of the seal arm 66 is positioned a gap distance from the distal end 52 of the trigger member 42 in the unactuated position.

As shown in FIGS. 5-10, the seal arm 66 has a distal end 76, where the drink seal 72 is connected, and a proximal end 116. In one embodiment the proximal end 116 of the seal arm 66 has a pair of pivot arms 142, which engages the retaining stop 140 to assist in pivoting the seal arm 66 to the full cleaning position (see FIG. 9) as described herein. As shown in FIGS. 4 and 9, the pivot arms 142 have a cam surface 144, which is preferably arcuate, that engages the retaining stop 140 to assist in allowing the seal arm 66 to be pivoted or rotated to the final open position by the hinge member 56 during full opening of the hinge member 56 to the final open position thereof.

In one embodiment the seal arm 66 also has a pair of followers 146. As shown in FIGS. 4, 6 and 10, in a preferred embodiment a first follower 146 extends transversely from one side of the seal arm 66 and a second follower 146 extends transversely from the opposing side of the seal arm 66. The followers 146 are used to guide the seal arm 66 into the appropriate position when the seal assembly 60 is moved from the cleaning position (FIGS. 8-10) to the use position (FIGS. 5, 6 and 10).

In a preferred embodiment the seal arm 66 also has a pair of seal arm extensions 114 extending transversely from the seal arm 66 at a position near the proximal end 116 of the seal arm to secure the seal arm 66 to the hinge member 56 in a rotating or pivoting manner. Referring to FIG. 7, the hinge member 56 has a pair of receivers or bores 118 into which each of the seal arm extensions 114 of the seal member 66 extends, respectively, and is pivotally or rotationally secured. Accordingly, in this manner the seal arm 66 is pivotally attached to the hinge member 56 between the proximal end 116 and the distal end 76 of the seal member 66. This allows the seal arm 66 to pivot with respect to the hinge member 56 both when the seal assembly 60 is in the use position and the trigger member 42 operates to actuate the trigger mechanism 16 to open the drink aperture 18, and when the seal assembly 60 is rotated outwardly for cleaning.

Two drink springs 70 are also provided as part of the seal assembly 60 to exert a force on the seal arm 66 to maintain the drink seal 72 in the closed position until a sufficient force is provided by the trigger member 42 against the engaging member 74 of the seal arm 66 to overcome the force of the drink springs 70 and thus pivot the seal arm 66 and drink seal 72 about the seal arm extensions 114 away from the drink aperture 18. In one embodiment, the drink springs 70 are torsion springs that exert a pressure on the seal arm 66 such that the drink seal 72 is forced away from the hinge member 56 and toward and against the drink opening 18 to close the drink opening 18 (see FIGS. 5 and 7). When the seal assembly is in the use position, the seal arm 66 is able to pivot to allow the drink seal 72 to be actuated, but the hinge member 56 remains fixed in place and does not move (see FIG. 6).

When the user desires to drink from the container 10, the user depresses the trigger member 42 by pushing the trigger member 42 inward toward the container body 12 with sufficient force to overcome the resistance force of the trigger spring 62 (see FIG. 6). The trigger member 42 moves inwardly and the vent seal 64 is moved from the entrance to the trigger chamber 31 and vent chamber 31*a*. During the beginning portion of the stroke of the trigger member 42, the distal end 52 of the trigger member 42 remains out of contact of the seal arm 66 because of the gap between the seal arm 66 and the trigger member 42 (see FIG. 5). When sufficient stroke of the trigger member 42 has occurred, the distal end 52 of the trigger member 42 will contact the seal arm 66. Further stroke movement of the trigger member 42 will operate to push against the engaging member 74 of the seal arm 66, thereby causing the seal arm 66 to rotate about the seal arm extension 114 at its pivot point 78 within the receivers 118 of the hinge member 56 because the hinge member 56 is fixed in the locked position (see FIG. 6). To pivot or rotate the seal arm 66 so that the drink seal 72 is removed from being adjacent the drink opening 18, the force exerted on the trigger member 42 must not only be sufficient to overcome the continuing force of the trigger spring 62, but also be sufficient to overcome the force of the drink springs 70, thus allowing the seal arm 66 to compress the drink spring 70 and have the drink seal 72 be moved away from the drink aperture 18 to allow liquid to escape out of the drink aperture 18 for drinking (see FIG. 6).

Figure 3:
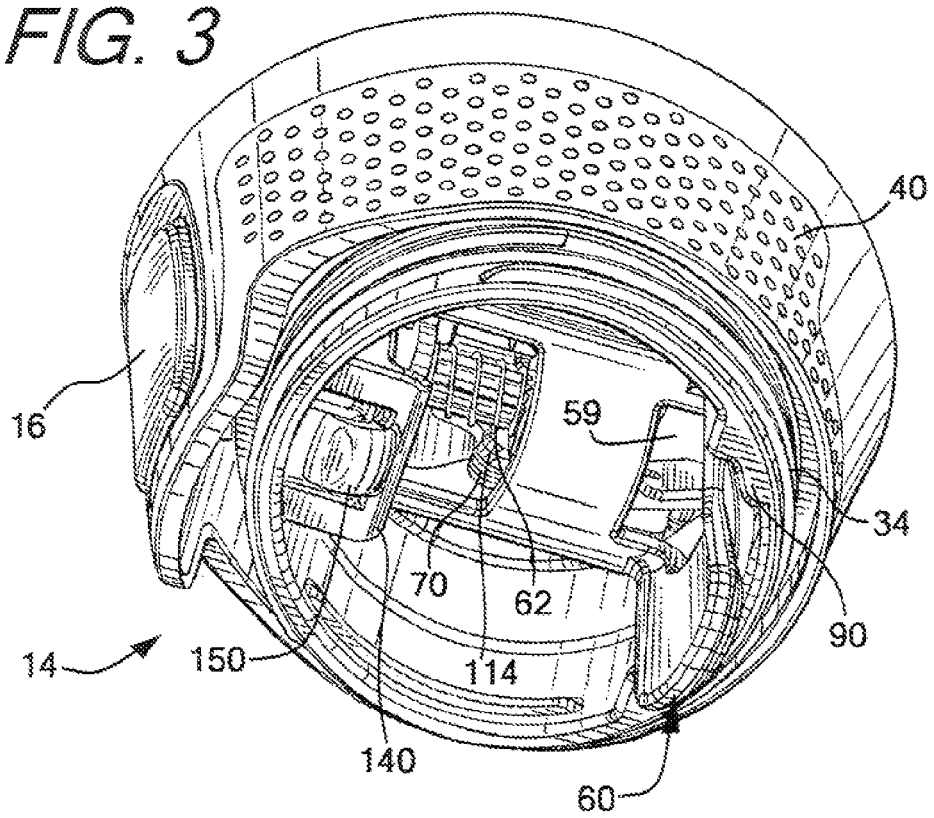
FIG. 3 is a bottom perspective view of the lid of FIG. 2.
Figure 4:
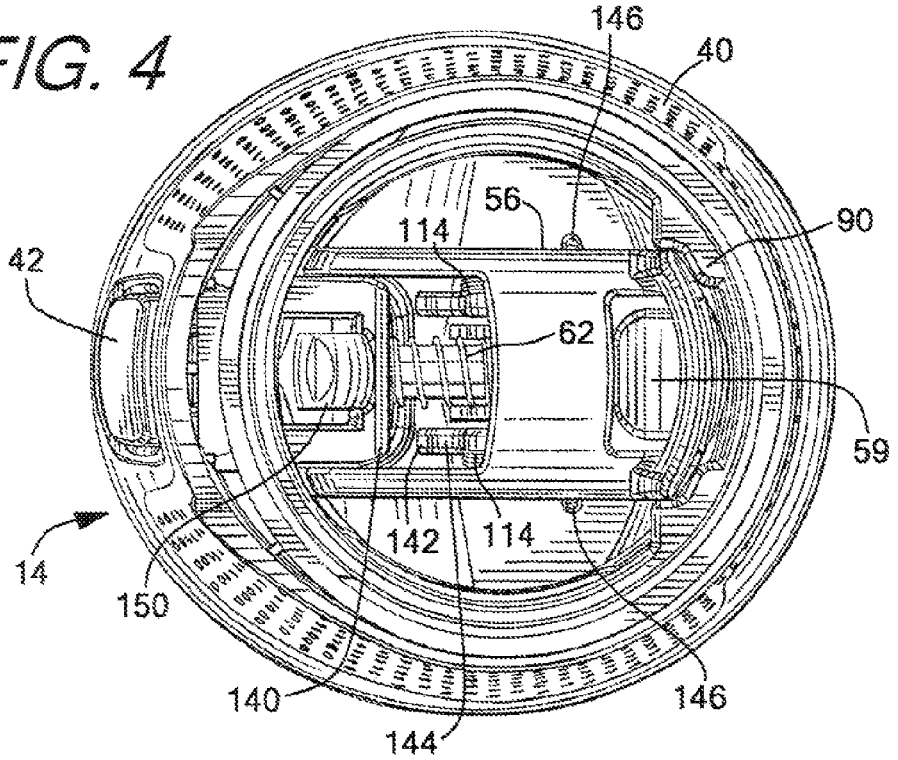
FIG. 4 is a bottom view of the lid of FIG. 2.

As shown in FIGS. 3-4 and 6, the hinge member 56 has an aperture 59. The aperture 59 helps to allow for the locking extension 69 of the hinge member 56 to flex as necessary. The aperture 59 also provides a flow area between the drink seal 72 and the drink aperture 18. The hinge member 56 also operates as a guard, such as an ice guard, to protect the trigger assembly 16 and to prevent ice or other items within the beverage container 10 from disrupting operation of the trigger assembly 16.

When the user removes force from the drink trigger 42 (i.e., generally by removing their finger or thumb from the trigger 42), the force of the drink springs 70 will force the seal arm 66 to pivot or rotate toward the lid housing 40 and thereby have the drink seal 72 forced against the drink opening 18 to close the drink opening 18. Further, the trigger spring 62 will continue to force the trigger 42 outwardly to seal the vent seal 64 against the outside of the seal chamber 31*a* and trigger chamber 31, thereby closing the vent opening 20.

If the user desires to clean the lid assembly 14, the user can rotate the seal assembly 60 away from the lid housing 40 to provide access to the area between the drink opening 18 and the drink seal 72 as well as all of the components under the hinge member 56 (see FIGS. 8-10). To do such, in one embodiment the user pushes the locking extension 69 of the seal arm locking member 68 inwardly, and preferably radially inwardly, toward the center of the lid housing 40. The locking extension 69 will flex at the joint with the hinge member 56 allowing the locking extension 69 to flex inwardly. When the flat 73 of the locking flange 71 clears the stop 93 of the receiving member 90 the user can also pull the seal arm locking member 68 outwardly from the lid housing 40. Additionally, if provided, the drop down spring exerts a force on the seal assembly 60 to rotate the seal assembly 60 into the cleaning position as shown in FIGS. 8-10. Alternately, if no drop down spring is provided, the drink spring 70 will provide a force on both the seal arm 66 and the hinge member 56 to rotate the seal assembly 60 toward the cleaning position.

In a preferred embodiment, when the locking flange 71 on the hinge member 56 clears the stop 93 of the receiving member 90, the drink spring 70 of the seal mechanism 60 begins to set the seal mechanism 60 into motion toward the cleaning position. Because the drink opening 18 is provided more radially outwardly, the first motion of the distal end 76 of the seal arm 66 is to move axially away from the drink opening 18. To do so, each of the followers 146 of the seal arm 66 follow a path on the surface of a respective lid cam 148, also referred to as a cam surface 148 for the lid housing 40, that extends from the bottom surface of the lid housing 40 (see FIGS. 8-10). Accordingly, the lid housing 40 is said to have a cam surface 148 and the seal arms 66 have cam followers 146 that engage the cam surface 148 to assist the seal arm 66 in traversing both generally radially and generally axially to extend the drink seal 72 to the drink aperture 18. In one embodiment, the lid cams 148 are preferably shaped to first have the distal end 76 portion of the seal arm 66 move axially from the drink opening 18, and then radially away from the drink opening 18 as the hinge member 56 moves out of the cavity of the lid housing 40. The drink seal 72 will move the seal assembly 60 essentially to the position identified in FIG. 8. At that point, the proximal end 116 of the pivot arms 142 of the seal arm 66 engages a portion of the retaining stop 140. Next, the user can push the hinge member 56 further outwardly. When that happens, the cam surface 144 of the pivot arms 142 engages the retaining stop 140. As the hinge member 56 is rotated outward further, the pivot arms 142 pivot about the retaining stop 140 to rotate the seal arm 66 upwardly and outwardly from the lid housing 40. During the last portion of the movement of the seal assembly 60, the hinge member 56 continues its last portion of rotation by pressing against and rotating over a detent 150 on the retaining stop 140 to retain the entire seal assembly 60 in the cleaning position shown in FIG. 9. Accordingly, the hinge member 56 in this embodiment exhibits rotational movement about the extensions 86 of the hinge member 56, and the seal arm 66 exhibits rotational movement, semi-radial movement and semi-axial movement.

To transition the seal assembly 60 from the cleaning state (FIGS. 8 and 9) to the use state (FIGS. 2-7), the user first is required to provide sufficient force to overcome the hinge member 56 residing on the cleaning side of the detent 150. When the hinge member 56 is pushed in a rotating manner past the detent 150, the pivot arms 142 generally rotate about the retaining stop 140, and then when the pivot arms 142 clear the stop 140 the drink spring 70 operates to rotate the seal arm 66 about the seal arm extension 114 at its pivot point 78 within the receivers 118 of the hinge member 56 (see FIG. 7). At that point, the followers 146 of the seal arm 66 will engage the top surface of the lid cams 148. When the user rotates the hinge member 56 toward the use position, the followers 146 will move radially on the top surface of the lid cams 148 and then axially on the side surface of the lid cams 148. Ultimately, the locking flange 71 on the hinge member 56 will engage the stop 93 of the receiving member 90, and at that time the drink seal 72 of the seal mechanism 60 will be properly seated on the drink aperture 18. Accordingly, the followers 146 of the seal arm 66 operate as cam followers, and a portion of the lid housing 40 operates as a cam surface 148 such that the cam followers 146 engage the cam surface 148 to assist the seal arm 66 in traversing both generally radially and generally axially to extend the drink seal 72 to the drink aperture 18. Accordingly, in one embodiment the seal arms 66 traverse both generally radially and generally axially to extend the drink seal 72 to the drink aperture 18.

The lid assembly 14 also has a trigger locking mechanism 44 to prevent the trigger 42 from being actuated when the trigger lock mechanism 44 is in the locked position. In one embodiment the trigger lock mechanism 44 comprises a moveable vent deflector 41 with a shoulder 120 that is adapted to engage a cutout 122 in the trigger member 42 and prevent inward movement (i.e., actuation) of the trigger member 42. The vent deflector 41 can be transitioned from the locked position (see FIG. 5), where the shoulder 120 of the vent deflector 41 is positioned within the trigger chamber 31, and more specifically within the cutout 122 in the trigger member 42, thereby contacting the trigger member 42 such that the trigger member 42 cannot be moved inwardly thereby preventing the trigger mechanism 16 from being actuated, to the unlocked position (see FIG. 6), where the shoulder 120 of the vent deflector 41 is positioned outside of the trigger chamber 31 and thus not in contact with the trigger member 42 such that the trigger member 42 can be moved inwardly to actuate the trigger mechanism 16.

Referring to FIG. 5, when the front end 130 of the vent deflector 41 toward the drink aperture 18 is in the up position, the rear end 132 of the vent deflector 41 is in the down position, and the shoulder 120 engages the cutout 122 in the trigger member 42 to prevent inward movement (i.e., actuation) of the trigger member 42. The front end 130 of the vent deflector 41 may have a visual indicator, such as a red color or words, such as "LOCKED", that appears when the trigger lock mechanism 44 is in the locked position to indicate to the user that the trigger mechanism 16 is locked and cannot be actuated. To allow for actuation, the user presses down on the front end 130 of the vent deflector 41, thereby pivoting the front end 130 downward and the rear end 132 of the vent deflector 41 upward as shown in FIG. 6. In this position, the shoulder 120 disengages from the cutout 122 in the trigger member 42 and allows the trigger member 42 to move inwardly when a force is applied by the user to the trigger member 42.

In various embodiments of the drinking container 10, the trigger mechanism 16 of the drinking container 10 may also have a tilt-lock mechanism (not shown). The tilt-lock mechanism prevents the trigger 42 from being actuated when the beverage container 10 is tilted, prior to the trigger 42 being actuated, beyond a certain angle, such as, for example, 15°. The tilt-lock mechanism may include a tilt-pendulum (not shown). The tilt-pendulum is preferably rotatedly connected to the trigger 42. The tilt-pendulum may have a pair of ears extending therefrom which operate to assist in locking the trigger mechanism 16 when the drinking container 10 is rotated beyond a certain angle, but only if the drinking container 16 is rotated before the trigger 42 is depressed. Accordingly, when the drinking container 10 is in the upright position, the tilt pendulum is free to fall straight down due to the effect of gravity. In this position the trigger 42 can be pressed, and the tilt pendulum does not make any contact with the lid housing 40. When the drinking container 10 is tilted forward prior to the trigger 42 being depressed, the tilt pendulum rotates forward as well, moving into a position that will cause a 'lock' between the lid housing 40 and the trigger 42, thereby preventing the trigger 42 from being depressed.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A cleanable lid assembly for a beverage container comprising a container body, the cleanable lid assembly comprising:

a lid housing having a connection member adapted to connect the lid housing to the container body, the lid housing also having a drink aperture positioned at least partially radially exterior of the connection member;

a seal assembly having a drink seal that closes the drink aperture, the seal assembly being connected to the lid housing while movable between a first or operable position and a second or cleaning position, wherein the drink seal is adjacent the drink aperture and is adapted to open and close the drink aperture in the first position, wherein the drink seal is distal the drink aperture and the drink aperture is open for cleaning the lid assembly when the seal assembly is in the second position;

a locking member connected to the seal assembly, the locking member moveable between a first position engaging the lid housing to retain the seal assembly in the first position, and a second position disengaged from the lid housing to allow the seal assembly to be transitioned to the cleaning position; and a trigger member connected to the lid housing and adapted to operate the seal assembly to open and close the drink aperture when the seal assembly is in the first position, wherein the trigger member is operated by pushing the trigger member in a direction substantially perpendicular to a longitudinal axis of the beverage container.

2. The cleanable lid assembly of claim 1, wherein the locking member is moveable radially inward from the first position to the second position to disengage the seal assembly from the first position.

3. The cleanable lid assembly of claim 1, wherein the seal assembly cannot be operated by the trigger member to open and close the drink aperture when the seal assembly is in the second position.

4. The cleanable lid assembly of claim 1, wherein the seal assembly further comprises a hinge member connected to the lid housing and a seal arm connected to the hinge member, the drink seal being connected to the seal arm.

5. The cleanable lid assembly of claim 4, wherein the seal arm traverses both generally radially and generally axially to extend the drink seal to the drink aperture.

6. The cleanable lid assembly of claim 5, wherein the lid housing has a cam surface and wherein the seal arm has a cam follower that engages the cam surface to assist the seal arm in traversing both generally radially and generally axially to extend the drink seal to the drink aperture.

7. The cleanable lid assembly of claim 4, wherein the hinge member has a first portion that is generally perpendicular to a longitudinal axis of the container body when the seal assembly is in the first position, and a second portion that is generally parallel to the longitudinal axis of the container body when the seal assembly is in the first position, the locking member extending from the second portion that is generally parallel to the longitudinal axis of the container body, and a joint between the first portion of the hinge member and the second portion of the hinge member, the second portion of the hinge member adapted to be flexed radially inward to disengage the locking member from the lid housing to transition the seal assembly to the cleaning position.

8. The cleanable lid assembly of claim 7, wherein the second portion of the hinge member extends radially exterior of the connection member of the lid housing when the seal assembly is in the cleaning position to assist in preventing the lid assembly from being connected to the container body when the seal assembly is in the cleaning position.

9. The cleanable lid assembly of claim 1, further comprising a spring to bias the seal assembly toward the cleaning position when the locking member is disengaged from the lid housing.

10. The cleanable lid assembly of claim 1, wherein the connection member is a thread ring.

11. The cleanable lid assembly of claim 10, wherein the locking member releasably engages a portion of the connection member to retain the seal assembly in the first position.

12. The cleanable lid assembly of claim 1, wherein the lid housing further comprises a vent aperture, and wherein the seal assembly further comprises a vent seal that closes the vent aperture.

13. A cleanable lid assembly for a beverage container comprising a container body, the cleanable lid assembly comprising:

a lid housing having a connection member adapted to connect the lid housing to the container body, the lid housing also having a drink aperture positioned at least partially radially exterior of the connection member;

a seal assembly having a hinge member connected to the lid housing, a seal arm connected to the hinge member, and a drink seal connected to the seal arm, the seal assembly being connected to the lid housing while movable between a first or operable position and a second or cleaning position, wherein the seal arm traverses both generally radially and generally axially to extend the drink seal to the drink aperture as the seal assembly transitions to the first position, the drink seal being adjacent the drink aperture and being adapted to open and close the drink aperture in the first position, and wherein the drink seal is distal the drink aperture and the drink aperture is open for cleaning the lid assembly when the seal assembly is in the second position; and a locking member connected to the seal assembly, wherein the locking member is adapted to engage the lid housing to retain the seal assembly in the first position, and wherein the locking member is adapted to be flexed radially inward to disengage the locking member from the lid housing, and a spring to bias the seal assembly toward the cleaning position when the locking member of the seal assembly is disengaged from the lid housing.

14. The cleanable lid assembly of claim 13, wherein the lid housing has a cam surface and wherein the seal arm has a cam follower that engages the cam surface to assist the seal arm in traversing both generally radially and generally axially to extend the drink seal to the drink aperture.

15. The cleanable lid assembly of claim 13, further comprising a trigger member connected to the lid housing and adapted to operate the seal assembly to open and close the drink aperture when the seal assembly is in the first position.

16. The cleanable lid assembly of claim 13, further comprising a drink spring to bias the drink seal against the drink aperture when the seal assembly is in the first position.

17. A cleanable lid assembly for a beverage container, comprising:

a lid housing having a drink aperture;

a seal assembly having a hinge member connected to the lid housing, a seal arm connected to the hinge member, and a drink seal connected to the seal arm, the seal assembly being connected to the lid housing while movable between a first or operable position and a second or cleaning position, wherein the lid housing has a cam surface, wherein the seal arm has a cam follower that engages the cam surface to assist the seal arm in traversing both generally radially and generally axially to extend the drink seal to the drink aperture as the seal assembly transitions to the first position, the drink seal being adjacent the drink aperture and being adapted to open and close the drink aperture in the first position, and wherein the drink seal is distal the drink aperture and the drink aperture is open for cleaning the lid assembly when the seal assembly is in the second position;

a locking member connected to the seal assembly, wherein the locking member releasably engages the lid housing to retain the seal assembly in the first position, and wherein the locking member is adapted to be flexed radially inward to disengage the locking member from the lid housing; and a spring to bias the seal assembly toward the cleaning position when the locking member is disengaged from the lid housing.

18. The cleanable lid assembly of claim 17, wherein the lid housing has a connection member adapted to connect the lid housing to a container body of the beverage container, and wherein the drink aperture is positioned at least partially radially exterior of the connection member.

19. The cleanable lid assembly of claim 17, further comprising a trigger member connected to the lid housing, wherein the trigger member is adapted to operate the drink seal when the seal assembly is in the first position, and wherein the drink seal cannot be operated by the trigger member when the seal assembly is in the second position.

20. A cleanable lid assembly for a beverage container comprising a container body, the cleanable lid assembly comprising:

a lid housing having a connection member adapted to connect the lid housing to the container body, the lid housing also having a drink aperture positioned at least partially radially exterior of the connection member;

a seal assembly having a drink seal that closes the drink aperture, the seal assembly being connected to the lid housing while movable between a first or operable position and a second or cleaning position, wherein the drink seal is adjacent the drink aperture and is adapted to open and close the drink aperture in the first position, wherein the drink seal is distal the drink aperture and the drink aperture is open for cleaning the lid assembly when the seal assembly is in the second position;

a locking member connected to the seal assembly, the locking member moveable between a first position engaging the lid housing to retain the seal assembly in the first position, and a second position disengaged from the lid housing to allow the seal assembly to be transitioned to the cleaning position; and a trigger member connected to the lid housing and adapted to operate the seal assembly to open and close the drink aperture when the seal assembly is in the first position, wherein the seal assembly further comprises a hinge member connected to the lid housing and a seal arm connected to the hinge member, the drink seal being connected to the seal arm, wherein the hinge member has a first portion that is generally perpendicular to a longitudinal axis of the container body when the seal assembly is in the first position, and a second portion that is generally parallel to the longitudinal axis of the container body when the seal assembly is in the first position, the locking member extending from the second portion that is generally parallel to the longitudinal axis of the container body, and a joint between the first portion of the hinge member and the second portion of the hinge member, the second portion of the hinge member adapted to be flexed radially inward to disengage the locking member from the lid housing to transition the seal assembly to the cleaning position, and wherein the second portion of the hinge member extends radially exterior of the connection member of the lid housing when the seal assembly is in the cleaning position to assist in preventing the lid assembly from being connected to the container body when the seal assembly is in the cleaning position.

21. A cleanable lid assembly for a beverage container comprising a container body, the cleanable lid assembly comprising:

a lid housing having a connection member adapted to connect the lid housing to the container body, the lid housing also having a drink aperture positioned at least partially radially exterior of the connection member;

a seal assembly having a drink seal that closes the drink aperture, the seal assembly being connected to the lid housing while movable between a first or operable position and a second or cleaning position, wherein the drink seal is adjacent the drink aperture and is adapted to open and close the drink aperture in the first position, wherein the drink seal is distal the drink aperture and the drink aperture is open for cleaning the lid assembly when the seal assembly is in the second position;

a locking member connected to the seal assembly, the locking member moveable between a first position engaging the lid housing to retain the seal assembly in the first position, and a second position disengaged from the lid housing to allow the seal assembly to be transitioned to the cleaning position;

a trigger member connected to the lid housing and adapted to operate the seal assembly to open and close the drink aperture when the seal assembly is in the first position; and a spring to bias the seal assembly toward the cleaning position when the locking member of the seal assembly is disengaged from the lid housing.

* * * * *